United States Patent [19]

McKay

[11] Patent Number: 5,000,431

[45] Date of Patent: Mar. 19, 1991

[54] LABEL REFOLDER

[75] Inventor: Roderick McKay, Rolling Meadows, Ill.

[73] Assignee: Weber Marking Systems, Inc., Arlington Heights, Ill.

[21] Appl. No.: 305,066

[22] Filed: Feb. 2, 1989

[51] Int. Cl.[5] ..... B41L 1/32

[52] U.S. Cl. ..... 270/039; 270/52; 493/410

[58] Field of Search ..... 270/1.1, 4, 5, 20.1, 270/32, 39, 40, 41, 52, 52.5; 493/410, 411, 412, 413

[56] References Cited

U.S. PATENT DOCUMENTS

| | | | |
|---|---|---|---|
| 2,368,683 | 2/1945 | Sherman | 270/52.5 |
| 2,906,527 | 9/1959 | Blain | 270/52.5 |
| 3,188,080 | 6/1965 | Kelliher | 493/411 |
| 3,214,160 | 10/1965 | Knudsen | 270/52.5 |
| 4,559,031 | 12/1985 | Gysling | 493/410 |

FOREIGN PATENT DOCUMENTS

| | | | |
|---|---|---|---|
| 35173 | 1/1964 | Fed. Rep. of Germany | 270/52.5 |
| 2316686 | 10/1973 | Fed. Rep. of Germany | 493/410 |
| 1288218 | 9/1972 | United Kingdom | 493/410 |

*Primary Examiner*—John T. Kwon
*Assistant Examiner*—Therese M. Newholm
*Attorney, Agent, or Firm*—Wallenstein, Wagner & Hattis, Ltd.

[57] ABSTRACT

The invention is a device for refolding fanfolded label-bearing webs as the webs are discharged from discharge point of a label printer. The device comprises three vertically spaced-apart wooden rods, including an uppermost, a middle, and a lowermost rod. The web is flattened as it passes generally vertically along and against the three rods. The middle rod is preferably disposed relative to the label printer at an angle of from 15 to 25 degrees from the discharge point. A deflector may be provided adjacent the discharge point for urging the web downwardly and towards the rods.

13 Claims, 2 Drawing Sheets

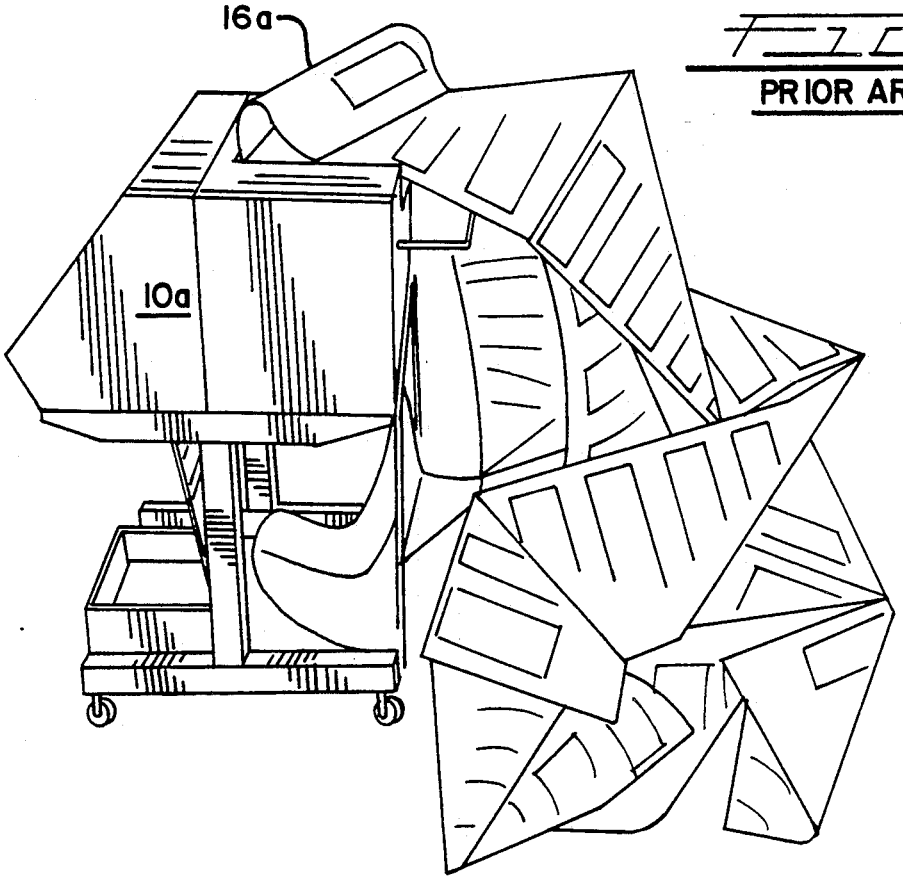
FIG. 1
PRIOR ART
FIG. 2
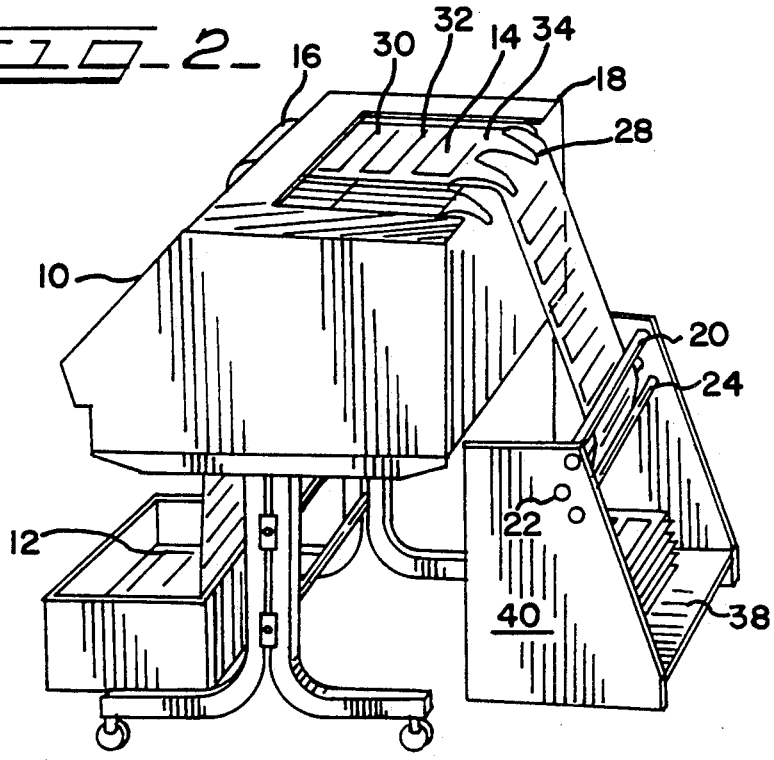

LABEL REFOLDER

TECHNICAL FIELD

The present invention relates generally to a device for the refolding, after passage through a printer, of previously fanfolded label-bearing webs.

BACKGROUND OF THE INVENTION

Custom labels are currently printed on state-of-the-art flexographic presses. The label stock from which the labels are made is most typically secured by an adhesive to a long and continuous and relatively narrow web. These presses can produce either roll or fanfolded labels up to 16" wide and 21" long.

In the case of fanfolded labels, these presses either include or operate in conjunction with a mechanism or apparatus that both imparts to the web a plurality of regularly-spaced crease lines at appropriate places along its length, and fanfolds the labels and their web along these crease lines and into a neatly stacked configuration.

These fanfolded labels may include blank portions for subsequent custom printing by either the label manufacturer or, increasingly, the ultimate label user. Such custom printing is generally done on a standalone electronic printer, such as the Legitronic TM electronic label printing systems assembled from various O.E.M. equipment and Legitronic software written by Weber Marking Systems, Inc., the assignee of the present invention.

The labels are fed across the generally flat top of such a printer, printed with the desired indicia, and then discharged at its far end. The top of the printer is typically thirty-five to forty (35"–40") inches from the floor Ideally, the discharging, printed labels and their web would have a "memory", and would begin both folding along their crease lines and restacking themselves on the floor below. In this way, the labels would reassume the neatly stacked, fanfolded configuration in which they were fed to the printer.

In practice, however, the labels and web frequently do not assume this configuration. Rather, the webs have an invariable tendency to become tangled as they are discharged from the printer and before reaching the floor. Once this tangling occurs, it can only be remedied by a machine custodian, who must straighten the web, refold it along its crease lines, and restack it properly. Often, this remedy requires that the custodian stop the printer, resulting in costly downtime. Occasionally, labels or webs will become damaged, torn, or otherwise rendered unusable by this tangling Machines have been devised to deal with this problem. However, they are costly to purchase and require periodic maintenance and repair In the absence of another, more inexpensive device, their cost may have been deemed reasonable by large label printers. However, smaller label printers may have found the cost of such machines prohibitive.

Accordingly, a low-cost and relatively low maintenance solution to the web-tangling problem was sought

SUMMARY OF THE INVENTION

The invention is a device for refolding fanfolded webs as those webs are discharged from the discharge point of what may generically be termed a web processing unit. Typically, labels are secured to the webs, and the web processing unit may be a label printer or the like.

The device comprises a plurality of vertically spaced-apart rods, preferably made of wood or any other non-conductive material As the web travels in a generally vertical path after its discharge from the printer, it passes along and against the rods. The rods flatten the passing web, and prevent it from bowing outwardly and into a position where it would have an increased tendency to become tangled or twisted In a preferred embodiment, three vertically spaced-apart rods, including an uppermost, a middle, and a lowermost rod, are provided In such an embodiment, the middle rod is preferably disposed at an angle of from about 15 to 25 degrees from the printer's discharge point.

To avoid the build-up of static electricity, the vertically spaced-apart rods are made of a non-conductive material, such as wood. As a further aid in ensuring the object of the present invention, an optional deflector adjacent the discharge point of the printer may be provided for urging the web downwardly and towards the rods.

BRIEF DESCRIPTION OF THE DRAWINGS

FIG. 1 is a view of the prior art arrangement, and one of the problems resulting from that arrangement;

FIG. 2 is a perspective view of a device in accordance with the invention, as that device is used in conjunction with an electronic label printer;

DETAILED DESCRIPTION OF THE PREFERRED EMBODIMENT

Figure 3:
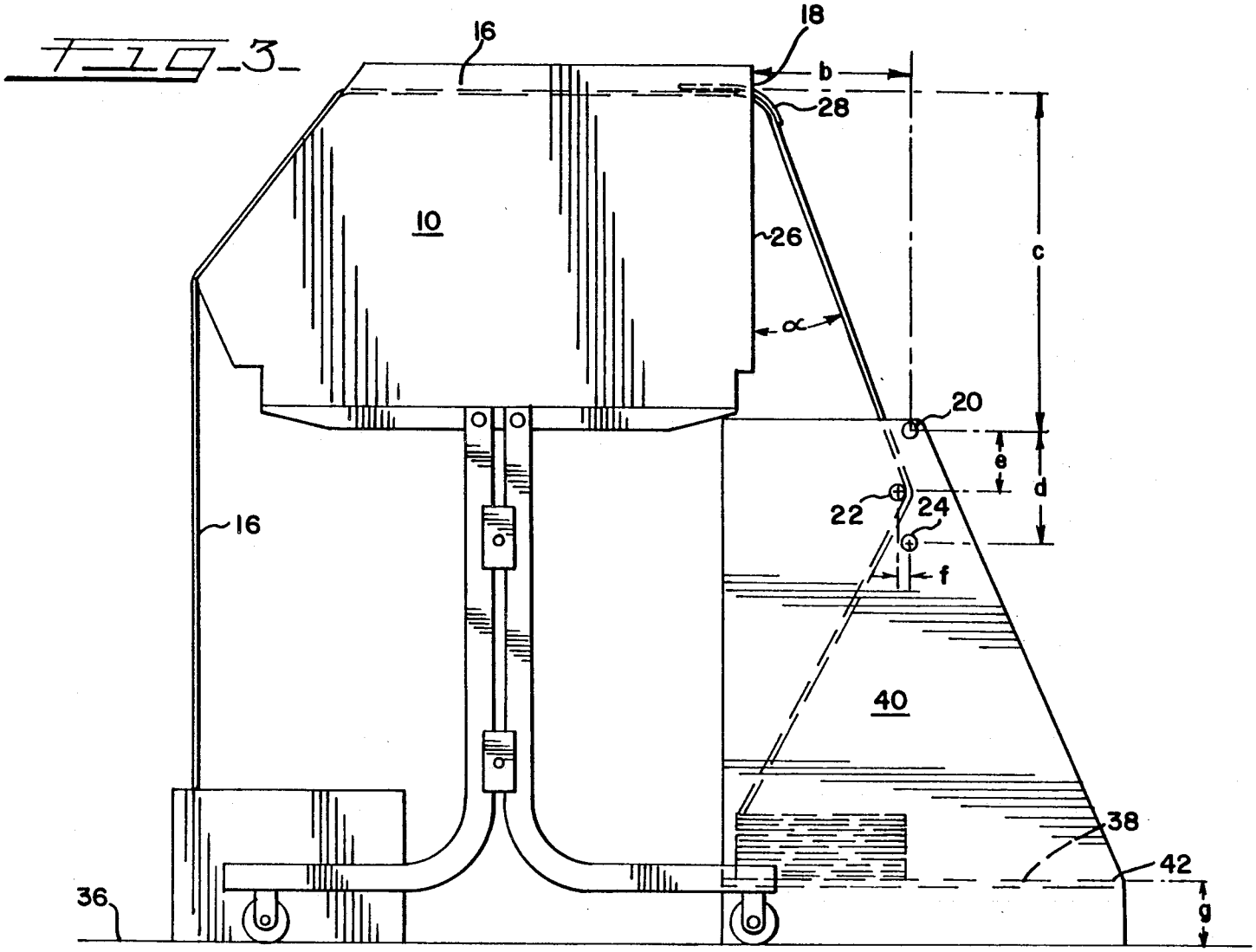
FIG. 3 is a side view of the device in accordance with the invention, and of the label printer of FIG. 2.

The present invention is shown generally in FIGS. 2 and 3. FIG. 2 shows the rear of a stand-alone electronic label printer 10, such as the Legitronic TM Model P-300/600 electronic printer supplied by Weber Marking Systems, Inc., of Arlington Heights, Illinois. This embodiment describes the use of the present invention with a label printer. It will be understood by those skilled in the art that the invention can be used effectively at the discharge of any web processing unit where tangling may arise upon the refolding of a previously fanfolded web.

A fanfolded stack 12 is shown in FIG. 2. FIG. 2 also shows a label-bearing web 16. A flexographic press produces blank labels and also prints logos or other indicia for the ultimate user onto labels 14, places creases in the web 16 to which the labels 14 are adhered, and fanfolds the web 16 along those creases and into the neatly configured stack 12 shown in FIG. 2. The labels include blank portions for subsequent printing by printer 10.

A leading edge of the web 16 is fed from the stack 12 and into the printer 10. From the perspective of FIG. 3, the web 16 is advanced from left to right. The web 16 rides along the top of and is supported by the printer 10. The web 16 ends its contact with the printer 10 at an upper corner, or discharge point 18. As will be seen, the preferred location of the present invention will be measured from this discharge point 18.

In its preferred embodiment, the present device comprises three vertically spaced-apart rods. For convenience and identification, the rods will be denominated the uppermost rod 20, the middle rod 22, and the lowermost rod 24. In this embodiment, these rods are of a circular cross-section and have a diameter of 0.75 inch. The rods are preferably of a length equal to or exceeding the width of the web 16. It will be understood by those skilled in the art from the implicit teachings of this specification that the rods used for the invention need not necessarily have a circular cross-section.

As will be seen, the labels 14 and web 16 move past these rods 20, 22, and 24. Friction between the web 16 and rods has the potential, under the right conditions, to cause a build-up of static electricity. This would be undesirable, in that it has been found in practice that static electricity further aggravates the problem solved by the present invention. Thus, to avoid such a build-up, the rods are preferably made of either wood or any other non-conductive material.

As stated above, the web 16 is supported by and rides horizontally along the top of the printer 10. The web 16 ends its contact with the printer 10 at an upper corner, or discharge point 18. The web travels in a generally vertical, downward path after its discharge from at the back end of the printer 10.

It has been found in practice that the present embodiment of this invention works best when the acute angle defined by the rear face 26 of the printer 10 and a line from the discharge point 18 of the printer 10 to the middle rod 22 is between about 15 degrees and 25 degrees. This angle is shown in FIG. 3 by the Greek letter, alpha.

As the web 16 leaves the discharge point 18, it bows outwardly somewhat, i.e., away from the printer 10, as shown in FIG. 3. As a result, the portion of the web 16 nearest the uppermost rod 20 is nearly directly overhead that rod 20. The web 16 passes along and against the rods 20, 22, and 24. The rods flatten the passing web, and remove this outward bowing. This is important, as a bowed web 16 would have an increased tendency to become tangled or twisted Some of the label-bearing webs used with the printers described in this specification are of a configuration and nature whereby they will tend to move downwardly toward the rods 20, 22, and 24 on their own accord upon leaving the discharge point 18. However, other label-bearing webs, such as those having a width of eight (8") inches or less or those having label cross perforations of three (3") inches or less, may have a tendency to resist such downward movement.

Thus, as a further aid in ensuring the object of the present invention, an optional deflector 28 adjacent the discharge point of the printer may be provided for urging such webs downwardly and towards the rods. It will be understood by those skilled in the art that there is nothing critical about the precise shape or location of the deflector 28 shown in this embodiment. A deflector 28 of any suitable shape, and secured to, integral with, and placed on or adjacent the printer to urge the web 16 downwardly will meet the objects of the present invention.

The present invention, as particularly described in this embodiment, has been effective in solving the prior problem. Without the present invention, a printer experienced the difficulties shown in FIG. 1. The label-bearing web 16*a*, upon discharge from the printer 10*a*, tended to become tangled and twisted. The machine custodian was required to straighten the web, refold it along its crease lines, and restack it properly This remedy occasionally required that the custodian stop the printer, resulting in costly downtime. When the present device was sent to the user of this printer and then used in accordance with instructions, the problem ceased.

All that the machine custodian needs to do is to grasp the leading edge of the web from the printer, and thread the web through the rods 20, 22, and 24 as shown in FIG. 3. The web 16 includes a plurality of creases, including creases 30, 32, and 34, which were placed into the web by the flexographic press on which the labels were first made. For the purposes of this invention, the uniform distance between creases 30 and 32 or creases 32 and 34 will be referred to as the "fold length."

As the web 16 moves towards the floor 36 of the room housing the printer 10, or towards the base 38 of a specially constructed stand 40 for support of the rods 20, 22, and 24, the machine custodian should arrange the first several folds of the web. Essentially, the custodian is "starting" the web 16 so that it will begin to refold in accordance with its memory, and resume the neatly stacked configuration in which it was fed to the printer 10. The objects of the present invention will be realized for a broad range of web widths and fold lengths. In fact, it is believed that the present invention will be effective for webs having a width of four to sixteen (4"–16") inches and a fold length of ten to eighteen (10"–18") inches.

FIG. 3 discloses the actual dimensions of an arrangement found suitable. As indicated above, the acute angle designated by the letter "alpha" has a value of between 15 and 25 degrees. Dimension "b" is the horizontal distance from the rear face 26 of the printer 10 to the vertical center lines of uppermost rod 20 and lowermost rod 24. Here, dimension "b" is seven (7") inches.

The vertical center line of middle rod 22 is offset somewhat from those of rods 20 and 24. In fact, the vertical center line of middle rod 22 is approximately 33/64"closer to the rear face of the printer than the vertical center lines of rods 20 and 24. This corresponds to the distance represented by dimension "f" of FIG. 3.

The vertical distance from the plane of the web 16 as it traverses the top of printer 10 to the center of the uppermost rod 20 is represented by dimension "c", and is approximately 15⅛".

The vertical distance from uppermost rod 20 to middle rod 22 and from uppermost rod 20 to lowermost rod 24 are represented by dimensions "e" and "d". These distances are three (3") inches and 5 5/16", respectively.

Finally, a dashed line in FIG. 3 represents the plane of the platform 42 of stand 40. Although not shown in FIG. 3, the distance from the lowermost rod 24 to this platform 42 is approximately fifteen (15") inches.

Although one embodiment of the present invention has been described, the scope of the invention is not to be limited by anything other than the claims In addition, structures that are equivalent to those described in the claims under the doctrine of equivalents are also deemed within the scope of this invention.

What I claim is:

1. A device for refolding fanfolded label-bearing webs as said webs are discharged from the discharge point of a label printer, said device comprising three vertically spaced-apart wooden rods, including an uppermost, a middle, and a lowermost rod, said web being flattened as it passes generally vertically along and against said rods, wherein said middle rod is disposed relative to said label printer at an angle of from 15 to 25 degrees from said discharge point.

2. The device as set forth in claim 1, further comprising a deflector adjacent said discharge point for urging said web downwardly and towards said rods.

3. A device for refolding fanfolded webs as said webs are discharged from the discharge point of a web processing unit, said device comprising at least three vertically spaced-apart rods, wherein said three vertically spaced-apart rods include an uppermost, a middle, and a lowermost rod, said web being flattened as it passes generally vertically along and against said rods, and wherein said middle rod is disposed relative to said web processing unit at an angle of from 15 to 25 degrees from said discharge point.

4. The device as set forth in claim 3, wherein said vertically spaced-apart rods are made of a non-conductive material.

5. The device as set forth in claim 4, wherein said non-conductive material is wood.

6. A device for refolding fanfolded webs as said webs are discharged from the discharge point of a web processing unit, said device comprising three vertically spaced-apart rods, including an uppermost, a middle, and a lowermost rod, wherein said middle rod is disposed relative to said web processing unit at an angle of from 15 to 25 degrees from said discharge point, and wherein said web is flattened as it passes generally vertically along and against said rods.

7. The device as set forth in claim 6, wherein said vertically spaced-apart rods are made of a non-conductive material.

8. The device as set forth in claim 7, wherein said non-conductive material is wood.

9. A device for refolding fanfolded webs as said webs are discharged from the discharge point of a web processing unit, said device comprising at least three vertically spaced-apart rods, wherein said three vertically spaced-apart rods include an uppermost, a middle, and a lowermost rod, said web being flattened as it passes generally vertically along and against said rods, and wherein said uppermost and lowermost rods are disposed along a vertical center line, and wherein said middle rod is offset from said vertical center line.

10. The device as set forth in claim 9, wherein said middle rod is disposed relative to said web processing unit at an angle of from 15 to 25 degrees from said discharge point.

11. The device as set forth in claim 9, wherein said vertically spaced-apart rods are made of a non-conductive material.

12. The device as set forth in claim 10, wherein said vertically spaced-apart rods are made of a non-conductive material.

13. The device as set forth in claim 12, wherein said non-conductive material is wood.

* * * * *